US005249059A

United States Patent [19]

Lee et al.

[11] Patent Number: 5,249,059

[45] Date of Patent: Sep. 28, 1993

[54] CATHODE-RAY TUBE HAVING EXPLOSION PROOF BAND

[75] Inventors: Kwang-sik Lee; Young-min Hwang, both of Kyungsangnam, Rep. of Korea

[73] Assignee: Samsung Electron Devices Co., Ltd., Kyunggi, Rep. of Korea

[21] Appl. No.: 802,545

[22] Filed: Dec. 5, 1991

[51] Int. Cl.[5] ..... H01J 9/18

[52] U.S. Cl. ..... 358/246; 358/242; 358/245

[58] Field of Search ..... 358/246, 245, 242, 237

[56] References Cited

U.S. PATENT DOCUMENTS 3,818,557 6/1974 Eisses et al. ..... 358/246

FOREIGN PATENT DOCUMENTS 1359368 8/1971 United Kingdom ..... 358/246

*Primary Examiner*—Edward L. Coles, Sr.
*Assistant Examiner*—Fan Lee
*Attorney, Agent, or Firm*—Leydig, Voit & Mayer

[57] ABSTRACT

A cathode-ray tube having an explosion proof band with a reinforced adhesion stability is disclosed. A plurality of projections are formed on the inner surface of the explosion proof band which is preferably concavely formed. Thus, cracking of the CRT can effectively be restrained by the explosion band.

7 Claims, 1 Drawing Sheet

CATHODE-RAY TUBE HAVING EXPLOSION PROOF BAND

BACKGROUND OF THE INVENTION

The present invention relates to a cathode-ray tube (CRT) having an explosion proof band, and more particularly to a cathode-ray tube having an explosion proof band with an improved close fixation effect.

Generally, the edge of a CRT panel 20 is fitted with an explosion proof band 30 as shown in FIG. 1. If cracking occurs from a strong outward shock to the CRT whose interior maintains a strong vacuum, explosion proof band 30 prevents the cracking from spreading. This prevents CRT 10 from exploding.

The conventional explosion proof band 30 is made of a metal having a high tension strength, and a lug 34 is welded to be fixed to each of the four corners of the band-shaped body. The explosion proof band 30 is banded to the sides around panel 10 (hereinafter referred to as banding face 21) to have a high tension strength. Such an explosion proof band 30 shown in FIG. 2 has a rectangular cross-sectional shape. A strip of adhesive tape T lies between band 30 and banding face 21 so as to prevent band 30 which is heated to a high temperature from directly contacting the banding face 21.

The explosion proof band as described above has a substantially rectangular cross-section. It also has such a treated surface so as to be very smooth, so that, even though it is indirectly attached to banding face 21 by adhesive tape T, the band can slip on either the adhesive tape T or the banding face 21. Particularly, once a high tension is given to the body of band 30, then the portion towards the outer surface expands a great deal more than its central portion. This causes a decline in the adhesive effect in connection to the banding face, thereby diminishing the explosion preventing effect.

SUMMARY OF THE INVENTION

Accordingly, it is the object of the present invention to provide a cathode-ray tube having an improved explosion proof band wherein the close fixation of the explosion proof band with respect to the banding face is so improved that a possible explosion phenomenon can effectively be prevented.

To achieve the above object of the present invention, there is provided a cathode-ray tube in which an explosion proof band is installed on the banding face of a panel, which is characterized in that a plurality of projections contacting the banding face are formed inside the explosion proof band and thereby reinforce the friction between the explosion proof band and the banding face. Therefore, relative movement between the explosion proof band and the banding face is restrained to a manimum.

In another embodiment of the present invention described above, the inner side of the explosion proof band on which projections are formed, is curved and concavely formed resulting in an improved explosion proof effect.

DETAILED DESCRIPTION OF THE INVENTION

Figure 1:
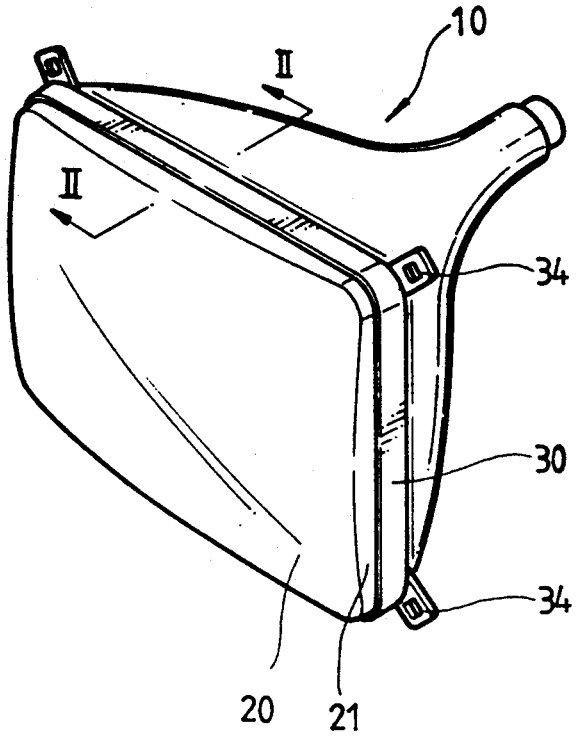
FIG. 1 is a perspective view of a cathode-ray tube having an explosion proof band.
Figure 2:
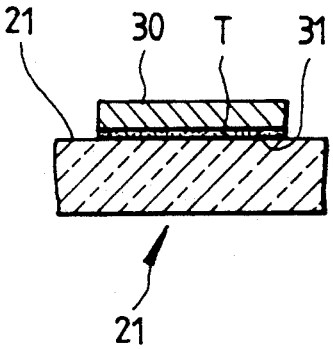
FIG. 2 is a fragmentary cross-sectional view along line II—II in FIG. 1.
Figure 3:
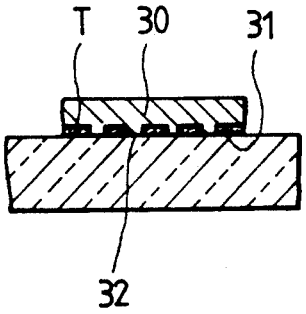
FIG. 3 is a fragmentary cross-sectional view showing the explosion band according to the present invention which corresponds to FIG. 2.

In FIG. 3, a state in which the explosion proof band 30 is loaded on the banding face 21 positioned at the edge of the panel 20 in the cathode-ray tube according to the present invention, is fragmentarily illustrated. The explosion proof band 30 is indirectly attached and fixed on the banding face 21, interposing the adhesive tape T there between. Here, a plurality of projections 32 are formed on inner side 31 of explosion proof band 30, with portions of each projection 32 buried into adhesive tape T. By doing so, slippage between the explosion proof band 30 and the adhesive tape T is prevented, and regardless of the fact that the adhesive tape lies between the explosion proof band and banding face, both the band and banding face firmly adhere to each other with direct adhesion effect.

Figure 4:
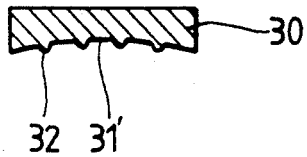
FIG. 4 illustrates the cross-section of the explosion band according to another embodiment of the present invention.

Meanwhile, a more advanced explosion proof band than that explained above can be employed in another embodiment of the present invention. As shown in FIG. 4, the cross-section of explosion proof band 30 is approximately an arch, wherein inner side 31 forms an arc. Accordingly, each edge of explosion band 30 is widened and thereby has have strong elastic force by high tension such that the extension of each and every portion of the explosion proof band body becomes even, and the band inside adheres to the same extent. Thus, the adhesion face thereof becomes enlarged. Namely, when a tension is applied to the body, an unbalanced extension is then maximally restrained because the edge of the body which is subjected to expansion by the tension is thicker than the central portion of the body.

In addition, each edge of the body as well as the projection 32 is subjected to an elastic deformation which causes the adhesion of the banding face become firm. In such an embodiment, a very stable and positive installation effect follows by virtue of both the friction improvement effect by the projections 32 and the body's arched cross-section which enable the effect thereof to improve.

Such an explosion proof band according to the embodiment of the present invention has no limitation in the material of the explosion proof band. Therefore, for example, the present invention as described above can be of course applied to such an explosion proof band of a strengthened synthetic resin type available. In the case of the synthetic resin explosion proof band, there might be no need for the conventional adhesive tape which attaches and fixes the band onto the banding face because the stability to the banding face of a panel is higher than that of metal.

As will be apparent to those skilled in the art, the present invention can be widely modified and varied. The scope of the present invention is not limited except as set forth in the accompanying claims.

What is claimed is:

1. A cathode-ray tube comprising:

a display panel having a banding face; and an explosion proof band disposed circumferentially about the banding face having an inner surface whereon a plurality of projections are formed which minimize relative movement between the banding face and said explosion proof band.

2. A cathode-ray tube according to claim 1, in which the inner surface of the explosion proof band on which said plurality of projections are formed is curved in the shape of an arc.

3. A cathode ray tube having an explosion proof band in accordance with claim 1, in which said explosion proof band is made of strengthened synthetic resin.

4. An explosion proof band for securing a cathode-ray tube and protecting the cathode-ray tube display panel from cracking, comprising:

a unitary strip of elastically deformable material sufficient in length to circumscribe a cathode-ray tube including an inner surface on which is formed a plurality of projections for securing said strip to a banding face of a cathode-ray tube and for reducing slippage between said strip and the banding face of the cathode-ray tube.

5. An explosion proof band according to claim 4 wherein the inner surface on which the projections are formed is an arc.

6. An explosion proof band according to claim 4 wherein the unitary strip is a strengthened synthetic resin.

7. An explosion proof band according to claim 4 wherein the unitary strip is a generally elastic metal.

* * * * *